US007441283B2

(12) United States Patent
Chu

(10) Patent No.: US 7,441,283 B2
(45) Date of Patent: Oct. 28, 2008

(54) FLUSH TOILET WITH ADD-ON LIQUID DISPENSER

(76) Inventor: Hui-Sheng Chu, No. 2, Lane 7, Sec. 2, Daguan Rd., Banciao City, Taipei County 220 (TW)

( * ) Notice: Subject to any disclaimer, the term of this patent is extended or adjusted under 35 U.S.C. 154(b) by 553 days.

(21) Appl. No.: 11/195,645

(22) Filed: Aug. 3, 2005

(65) Prior Publication Data

US 2007/0028376 A1 Feb. 8, 2007

(51) Int. Cl.
*E03D 9/02* (2006.01)

(52) U.S. Cl. ..... 4/227.1

(58) Field of Classification Search ..... 4/225.1, 4/227.1–227.7

See application file for complete search history.

(56) References Cited

U.S. PATENT DOCUMENTS 724,209 A * 3/1903 Rockwell ..... 4/227.2
939,424 A * 11/1909 Kneen ..... 4/227.1
2,620,486 A * 12/1952 Addlesburger ..... 4/227.1
5,073,992 A 12/1991 Herring et al.

* cited by examiner

*Primary Examiner*—Robert M Fetsuga

(57) ABSTRACT

A flush toilet includes a water tank with at least one through hole and a liquid dispenser installed outside on the water tank. The water tank includes a tank body and a lid covered on the tank body, the through hole is formed on the lid and the liquid dispenser is also installed on the lid. The liquid dispenser includes a container, a dispensing component mounted on the container and a tube with one end connected to the dispensing component and the other end inserted inside the water tank via the through hole. As such, users can visually check the level of liquid in the container for replenishment and casually choose different smell or strength of liquid for use with the toilet.

8 Claims, 6 Drawing Sheets

FLUSH TOILET WITH ADD-ON LIQUID DISPENSER

BACKGROUND OF THE INVENTION

1. Field of Invention

The present invention relates in general to a flush toilet with an add-on liquid dispenser, and more particularly, to a liquid dispenser being installed outside a flush toilet so that users can visually check the level of liquid in the container of the dispenser for replenishment and casually choose different smell or strength of liquid for use with the toilet.

2. Related Art

Using bathroom is a part of our daily life. Since toilets may contain germs to contaminate the bath wares such toothbrush, cups, towels and so on, it is desired to have the toilet been cleaned and disinfected after every time use.

Taiwanese Patents No. 514085, 502763, 351365 and U.S. Pat. No. 5,073,992 disclose different detergent dispensers for a toilet. However, these detergent dispensers are all used to be installed inside the water tank of the toilet. In a long-term use, it is inconvenient to replace the detergent dispenser or replenish the detergent. On the other hand, because the detergent dispenser is immersed in the water, gross and slippery attachment may grow outside the detergent dispenser. Moreover, it is impossible to check the residual amount of the detergent dispenser visually.

SUMMARY OF THE INVENTION

Accordingly, the present invention is to provide a flush toilet with a liquid dispenser installed outside a water tank of the flush toilet so that users can visually check the level of liquid in a dispenser container for replenishment and casually choose different smell or strength of liquid for use with the toilet.

The flush toilet of the present invention includes a water tank with at least one through hole and a liquid dispenser installed outside on the water tank. The water tank includes a tank body and a lid covered on the tank body, the through hole is formed on the lid and the liquid dispenser is also installed on the lid. The liquid dispenser includes a container, a dispensing component mounted on the container and a tube with one end connected to the dispensing component and the other end inserted inside the water tank via the through hole.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
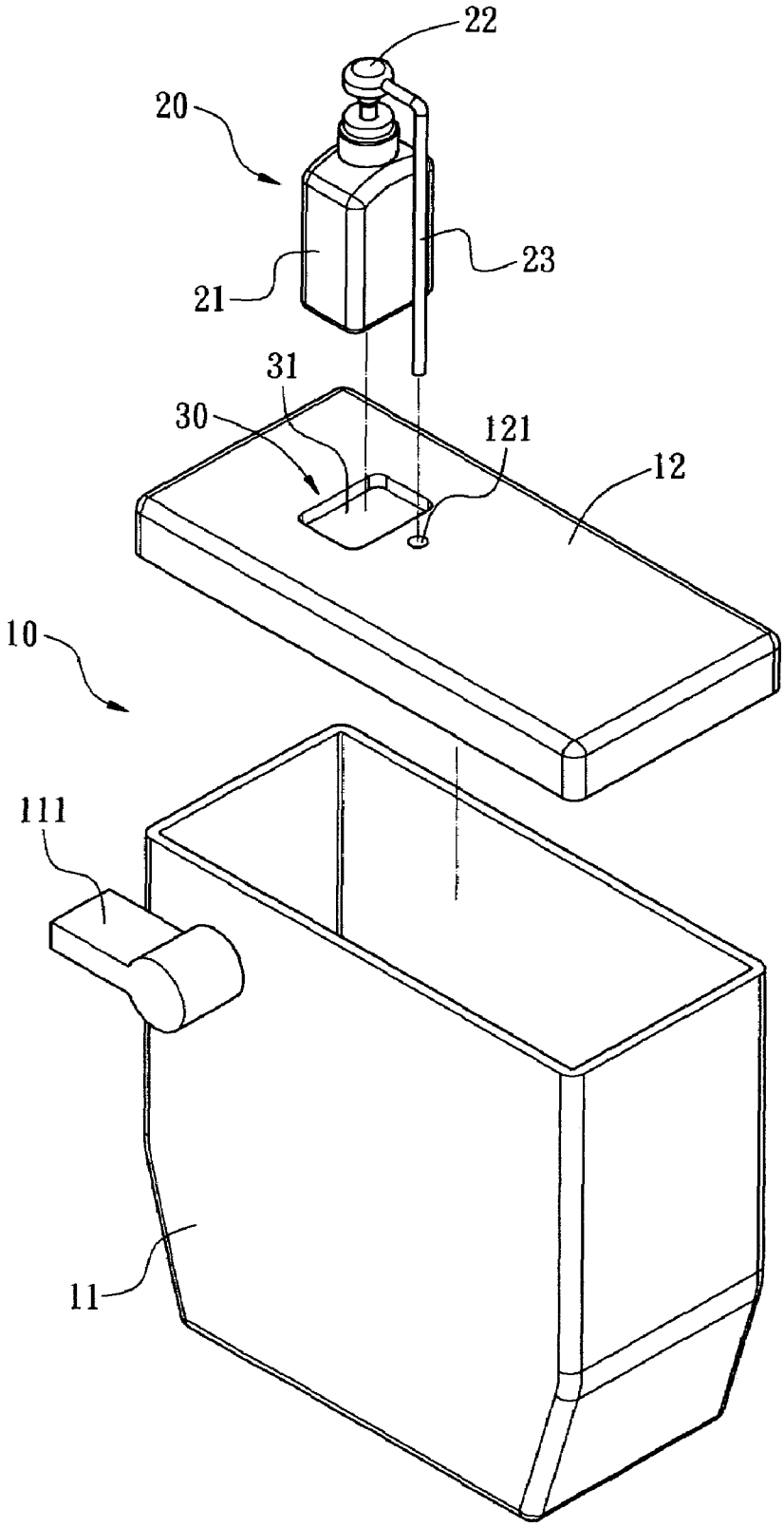
FIG. 1 shows an exploded view of a flush toilet according to the present invention.
Figure 2:
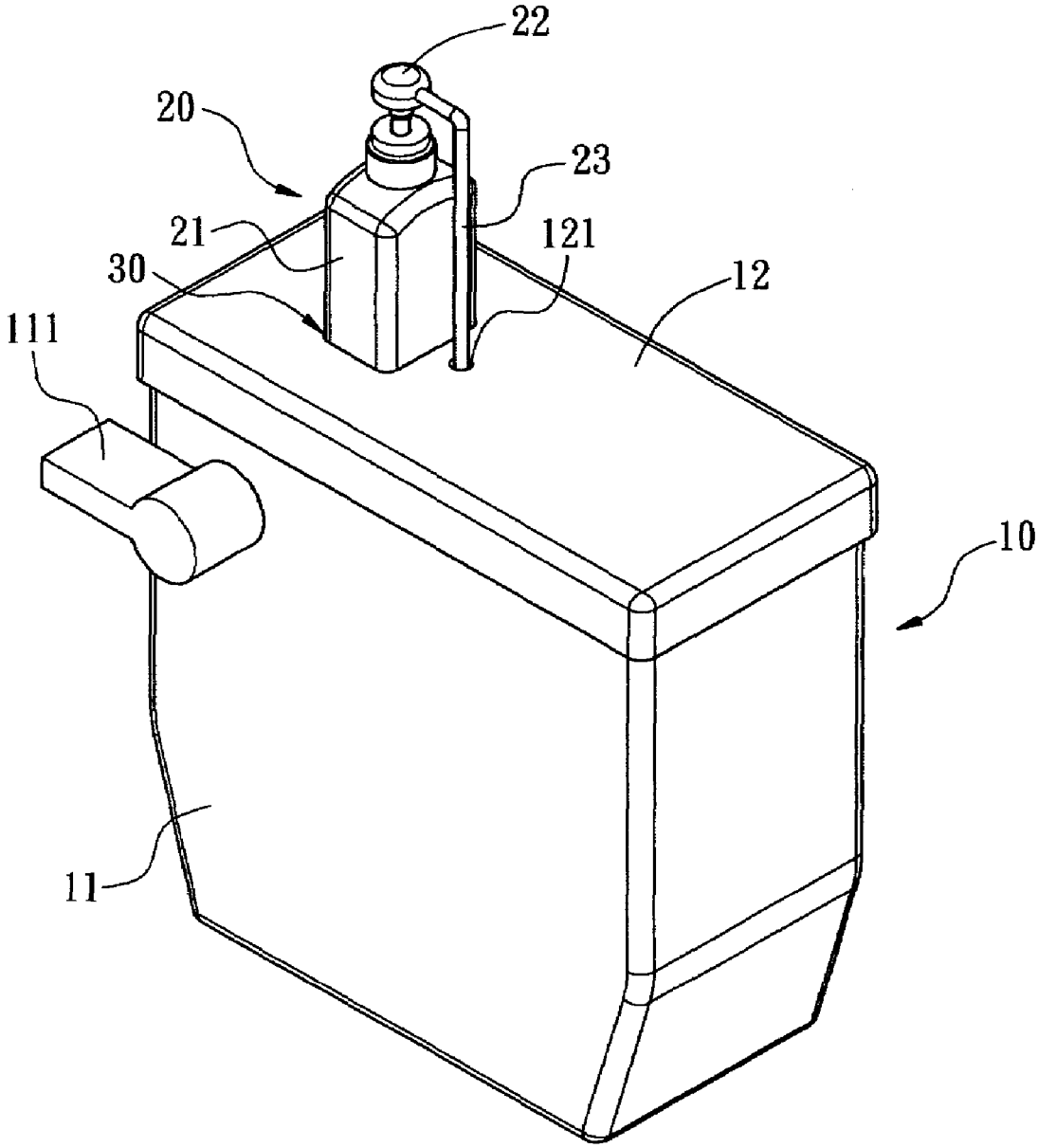
FIG. 2 shows a perspective view of the flush toilet.

Referring to FIGS. 1 and 2, a flush toilet of the present invention includes a water tank 10 and a liquid dispenser 20 installed outside on the water tank 10. The water tank 10 includes a tank body 11 and a lid 12 covered on the tank body 11. The water tank 10 has an inlet and an outlet pipes connected thereto, and a float installed and appropriate water contained therein as in convention. A discharging lever 111 is mounted around the upper left comer of the front surface of the water tank 10 for controlling water in and out of the water tank 10. The lid 12 has a through hole 121 formed thereon. The through hole 121 can be is in a circular, a rectangular, a square or an oval shape.

The liquid dispenser 20 includes a container 21, a dispensing component 22 mounted on the container 21 and a tube 23 with one end connected to the dispensing component 22 and the other end inserted inside the water tank 10 via the through hole 121. The container 21 can be made of transparent or semitransparent material so that users can check the existing amount of the liquid in the container 21 visually. Different smell or strength of liquid can be filled in the container 21 for cleaning and disinfecting purposes. Preferably the dispensing component 22 is a dispenser pump for drawing the liquid out of the container 21 and transporting into the water tank 10 via the tubes 23.

Furthermore, a fixing portion 30 is formed on the water tank 10 for receiving the liquid dispenser 20. The fixing portion 30 can be formed as a recess with a receiving space 31 on the lid 12, as shown in FIGS. 1 and 2, or as an enclosure as shown in FIGS. 5 and 6 The receiving space 31 has a size fitted to the size of the container 21, so that the liquid dispenser 20 can be secured in the fixing portion 30.

Figure 3:
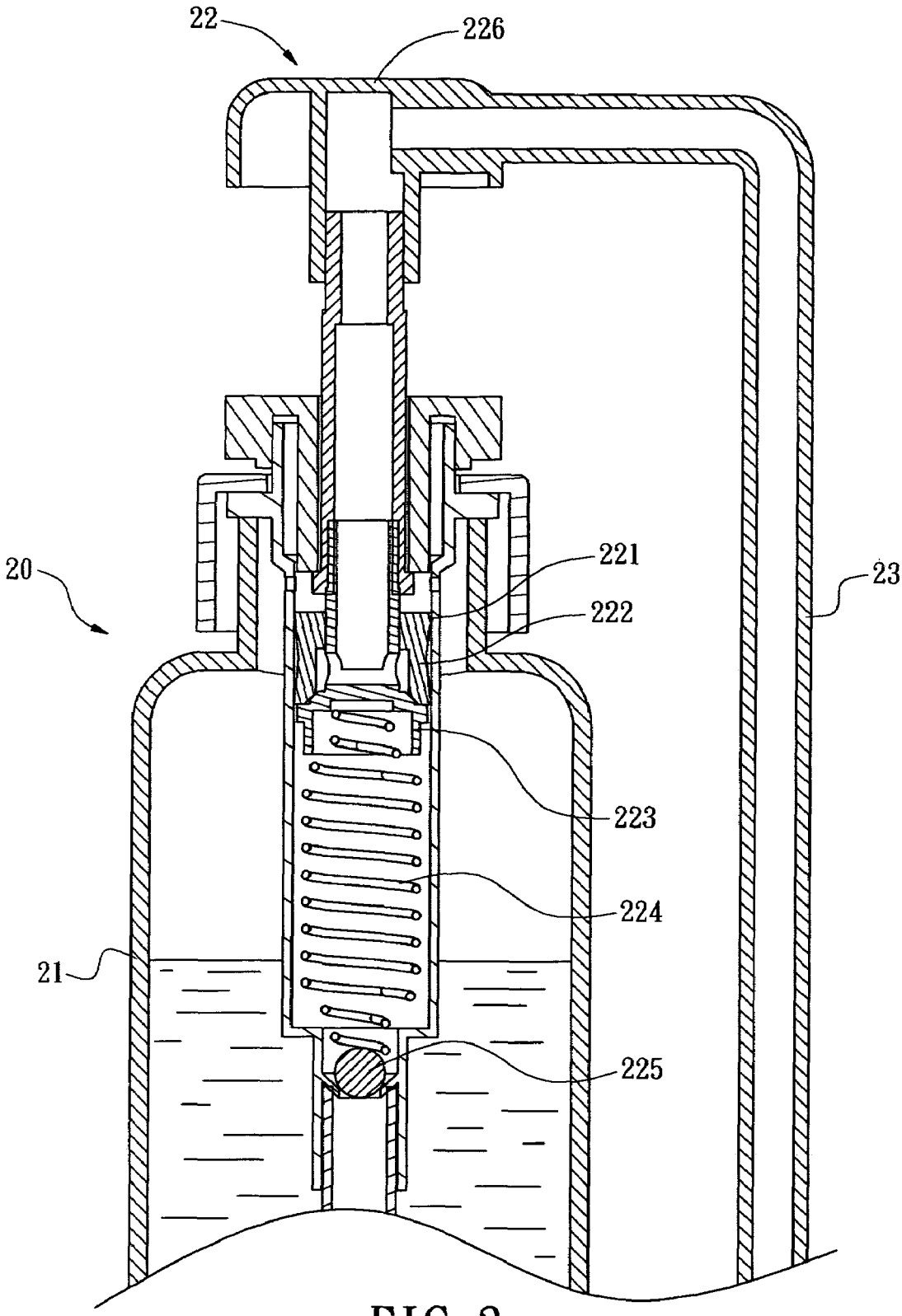
FIG. 3 shows a cross sectional view of a liquid dispenser of the flush toilet.
Figure 4:
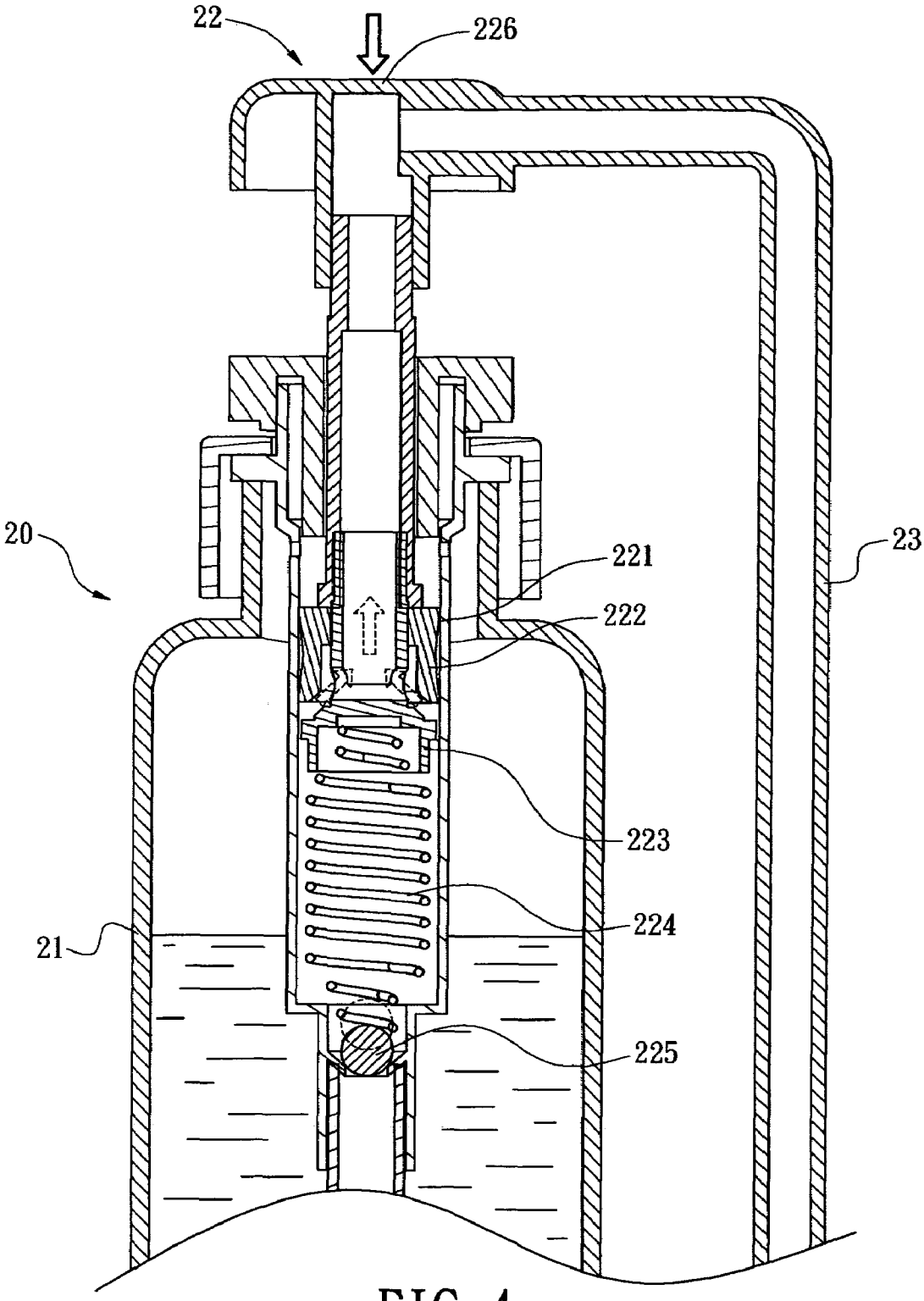
FIG. 4 shows a cross sectional view of a liquid dispenser of the flush toilet in use.

In use, please refer to FIGS. 3 and 4, first the dispenser pump 22 is taken off to fill an appropriate amount and a selected kind of liquid in the container 21. After the dispenser pump 22 is securely mounted to the top of the container 21, the liquid dispenser 20 is put in the receiving space 31 of the fixing portion 30, and the tube 23 is connected between the liquid dispenser 20 and the water tank 10, as shown in FIG. 2. The dispenser pump 22 includes a cylinder body 221 and a pushing head 226, a cylindrical seat 222, a valve 223 corresponding to the cylindrical seat 222, a resilient element 224 and a ball valve 225 being disposed inside the cylinder body 221. The cylindrical seat 222 fixedly mounted on the upper sidewall of the cylinder body 221. The resilient element 224 is located between the valve 223 and the ball valve 225 to push the valve 223 against the cylindrical seat 222 as well as push the ball valve 225 against the end gate of the cylinder body 221. The pushing head 226 has a distal end passed through the cylindrical seat 222 to contact with the valve 223. After pushing down the pushing head 226 several times at first use, the liquid in the container 21 will begin to fill the room of the cylinder body between the valve 223 and the ball valve 225. Therefore, when the valve 223 is pushed away from the cylindrical seat 222 by the pushing head 226, the liquid will flow into the inner passage of the pushing head 226. Further, the liquid will flow through the tube 23 into the water tank 10. Under the liquid with higher viscosity, one may need to push the pushing head 226 more times to achieve the transportation of the liquid.

Figure 5:
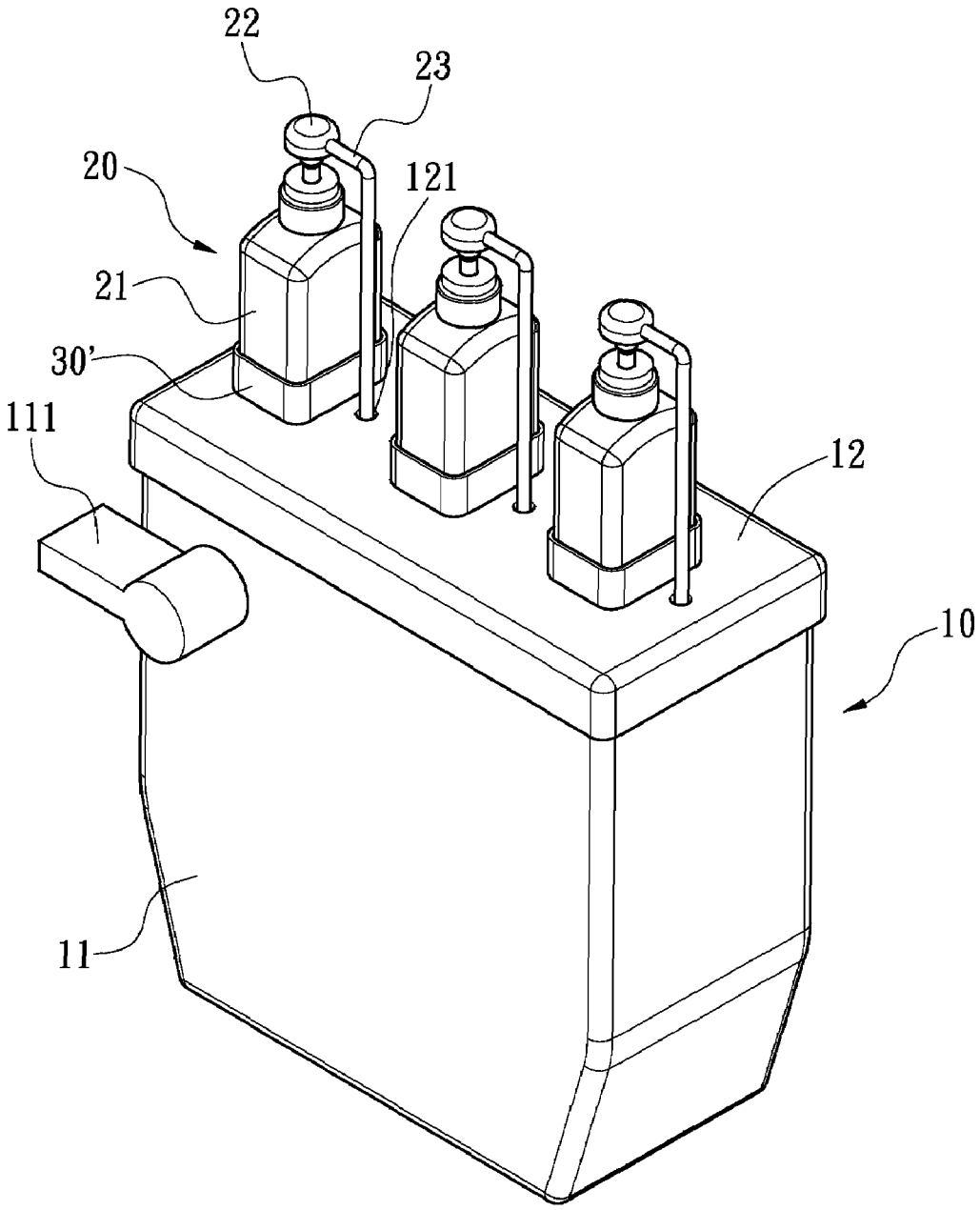
FIG. 5 shows another preferred embodiment of the present invention.

In another embodiment, as shown in FIG. 5, several liquid dispensers 20 are aligned on the lid 12 to fit in the enclosure 30, respectively. There are same numbers of through holes 121 with respect to the liquid dispensers 20 formed on the lid 12 each to receive the corresponding tube 23 of the liquid dispenser 20. As such, different kind of liquid with refreshing, deodorizing and/or disinfecting function can be used in the individual liquid dispenser 20.

Figure 6:
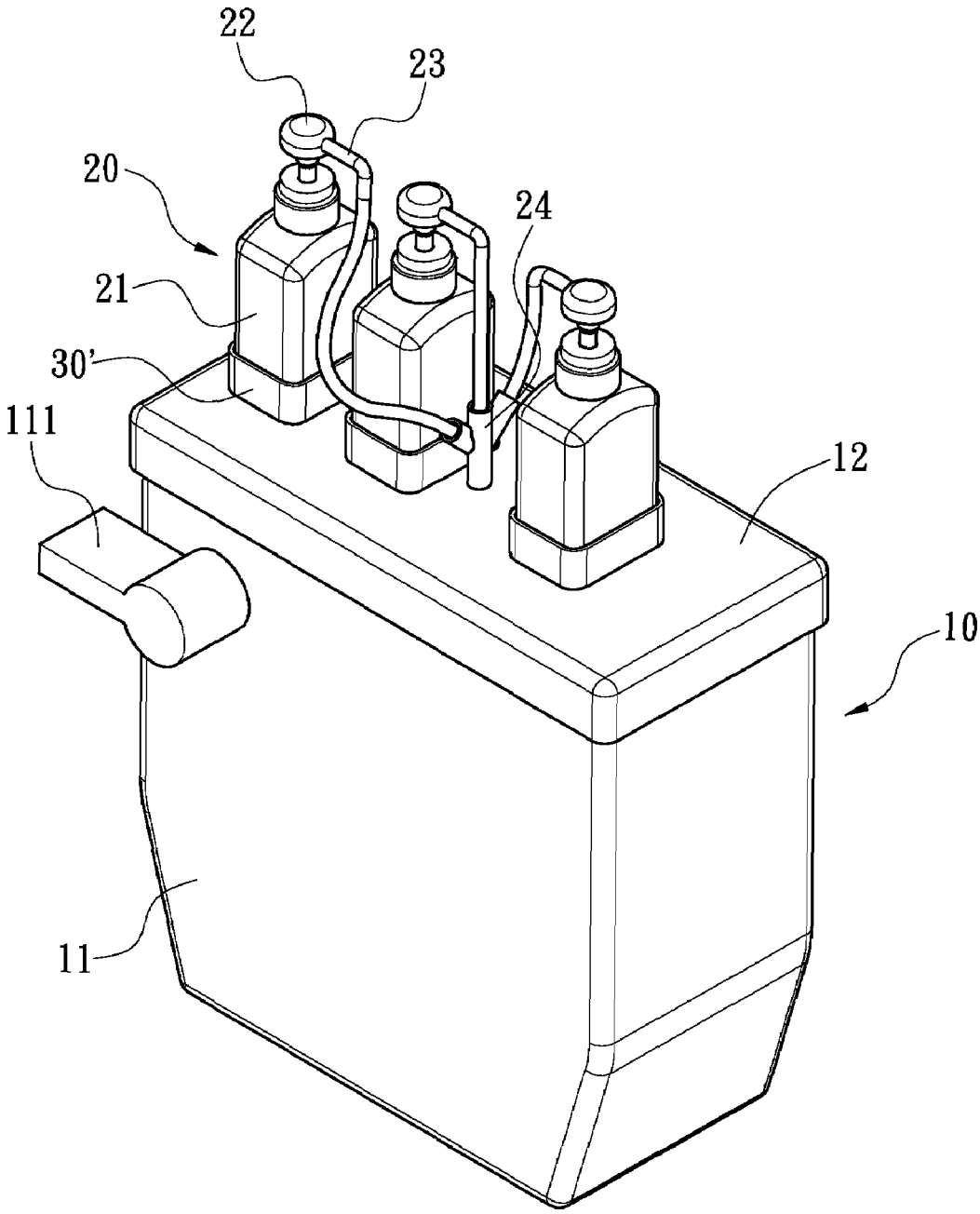
FIG. 6 shows still another preferred embodiment of the present invention.

Still in another embodiment, as shown in FIG. 6, only one through hole 121 is formed for several liquid dispensers 20. A multi-connector 24 has to be provided. The multi-connector 24 has one connecting portion connected to the through hole 121 and three other connecting portions connected to tubes of the three liquid dispensers, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A flush toilet comprising:

a water tank with at least one through hole, the water tank comprising a tank body and a lid covered on the tank body, the through hole formed on the lid; and a liquid dispenser installed outside on the water tank, including a container, a dispensing component mounted on the container and a tube with one end connected to the dispensing component at a top portion of the dispensing component outside the water tank and the other end inserted inside the water tank via the through hole wherein the lid defines a recess adjacent to the through hole for receiving the liquid dispenser.

2. The flush toilet of claim 1, wherein the through hole is in a circular, a rectangular, a square or an oval shape.

3. The flush toilet of claim 1, wherein the lid has an enclosure formed thereon for the liquid dispenser to be installed in the enclosure.

4. The flush toilet of claim 1, wherein the container is made of transparent or semitransparent material.

5. The flush toilet of claim 1, wherein the dispensing component is a dispenser pump.

6. The flush toilet of claim 1, wherein a plurality of liquid dispensers are aligned on the top of the water tank.

7. The flush toilet of claim 6, wherein a plurality of through holes are formed respectively to receiving tubes of the liquid dispensers.

8. The flush toilet of claim 6, further comprising a multi-connector with one connecting portion connected to the through hole and a plurality of connecting portions connected to tubes of the liquid dispensers, respectively.

* * * * *